US005497538A

United States Patent [19]

Graf et al.

[11] Patent Number: 5,497,538

[45] Date of Patent: Mar. 12, 1996

[54] DEVICE FOR TEXTURIZING CONTINUOUS FILAMENT THREADS

[75] Inventors: Felix Graf, Winterthur; Jorg Maier, Frauenfeld; Rudi Wagner, Russikon; Armin Wirz, Ossingen, all of Switzerland

[73] Assignee: Maschinenfabrik Rieter AG, Winterthur, Switzerland

[21] Appl. No.: 269,780

[22] Filed: Jul. 1, 1994

[30] Foreign Application Priority Data

Jul. 2, 1993 [CH] Switzerland ..... 1993/93

[51] Int. Cl.[6] ..... D02G 1/12

[52] U.S. Cl. ..... 28/255; 28/264

[58] Field of Search ..... 28/255, 256, 221, 28/247, 249, 254, 263, 264

[56] References Cited

U.S. PATENT DOCUMENTS 4,631,790 12/1986 Nabulon .

4,854,019 8/1989 Nabulon .

FOREIGN PATENT DOCUMENTS 0071354 2/1983 European Pat. Off. .
0163039 12/1985 European Pat. Off. .
0282815 9/1988 European Pat. Off. .
527931 10/1972 Switzerland .

*Primary Examiner*—C. D. Crowder
*Assistant Examiner*—Larry D. Worrell, Jr.
*Attorney, Agent, or Firm*—Greenblum & Bernstein

[57] ABSTRACT

A device for texturizing continuous filament threads including plates in a crimping part which have a prolongation at both ends thereof, with the prolongation being located centrically-symmetrically, however offset, relative to each other and have rounded end faces thus permitting reversing the plates upon wear of one end face thereof, thus increasing their service life.

11 Claims, 2 Drawing Sheets

DEVICE FOR TEXTURIZING CONTINUOUS FILAMENT THREADS

CROSS REFERENCE TO RELATED APPLICATIONS

This application claims the priority of Swiss Application No. 01 993/93-3, filed Jul. 2, 1993, the disclosure of which is incorporated herein by reference in its entirety.

BACKGROUND OF THE INVENTION

1. Field of the Invention

The present invention relates to a device for texturizing continuous filament threads by means of heated flowing media, the device including a thread infeed part for taking in the threads, a treatment part connected with the infeed part and a treatment chamber for heating the threads, and a crimping part, the crimping part containing a slot nozzle, with the crimping part being connected to the treatment part, with the heated threads being stuffed into the crimping part for forming a crimping in the threads, the slot nozzle being provided with plates having slots, the plates having an essentially rectangular cross section and being radially arranged with their narrow sides facing the stuffed thread, with every plate taking the form of a flat steel part.

2. Discussion of the Background of the Invention and Material Information

Swiss Patent Publication No. 527,931 discloses a device as set forth above in the Field of the Invention wherein the plates have an essentially rectangular cross section, with the narrow side facing the stuffed thread, and are permanently arranged in a radial manner.

During the use of slot nozzles for texturizing continuous filament threads there exists the problem that the thread snarls, located in the stuffer box, penetrate more or less deeply into the space between the plates, depending on the degree of plastification of the threads, the previous treatment of the threads with any kind of treatment and dyeing agent, as well as depending upon the frictional conditions at the end faces of the plates facing the thread, and in this way change, to an undetermined degree, the frictional conditions for the transporting of the quantity of thread in the stuffer box.

A further shortcoming consists in that the frictional conditions are subject to continuous change on account of the wear of the end faces of the plates, this requiring continuous control of the texturizing product and simultaneously a corresponding adaptation of the operating conditions in relation to the media supply, respectively requiring frequent replacement of the slot nozzles. These frequent replacements of the slot nozzles as well as frequent checks of the finished yarn are furthermore very demanding in terms of labor and costs.

Therefore it was the object of another invention, published in the European Patent Application No. 0,163,039 B, to remedy these shortcomings and to produce a device for the crimping of threads in which the crimping characteristics of the finished texturized thread, with essentially unchanged conditions in relation to the media supply, are within a useable tolerance over a longer period of time. A further object consisted in avoiding the frequent replacement of the slot nozzle.

According to the noted invention, this object was solved by European Patent No. 0,163,039 B, in that each plate is a flat steel part which is rounded and polished at the thread guiding end face. Advantageous embodiments consist in that the plates are attached in the slot nozzle in a replaceable or pluggable manner.

An advantage of the noted invention consisted in that, by rounding the end faces and by polishing, there existed the possibility of forming this thread transporting surface such that the operating conditions, defined by the friction between the tread and this surface, are subjected to substantially fewer changes due to the wear of the end face.

Furthermore, the exchangeable attachment entailed the advantage that the plates can be replaced in a simple manner after a certain time interval so that the operating conditions stay within acceptable tolerances.

The shortcoming of this nearest state of the art is that the plates are both relatively expensive and still had to be replaced after a relatively short predefined time period.

SUMMARY OF THE INVENTION

The primary object or purpose of this invention is to increase the application or use of the plates, with the advantage of the invention consisting in doubling the service life of the plates.

One embodiment of this invention pertains to a device for texturizing continuous filament threads by means of heated flowing media, the device including a thread infeed part for taking in the threads, a treatment part connected with the infeed part and having a treatment chamber for heating the threads, and a crimping part, the crimping part containing a slot nozzle, with the crimping part being connected to the treatment part, with the heated threads being stuffed into the crimping part for forming a crimping in the threads, the slot nozzle being provided with plates being inserted in slots, the plates having an essentially rectangular cross having first and second end faces and being radially arranged with one of the end faces facing the stuffed thread, with every plate taking the form of a flat steel part, with the ends of each plate being provided with a prolongation, with these prolongations having a width smaller than the width of the plate, wherein one prolongation borders directly on one of the end faces of the plate and the other prolongation borders directly on another one of the end faces of the plate.

In a further embodiment of this invention, each prolongation has the same length and the same width.

In another embodiment of this invention, each plate end includes, in addition to the prolongation, a chamfer between the prolongation and a bordering one of the end faces of the plate and opposite to the prolongation, with the chamfer, together with the bordering one of the end faces, defining an angle within a given angle range.

In an additional embodiment of this invention, the angle lies within a range of 120° and 150°.

In yet a further embodiment of this invention, the end faces of the plates are rounded and polished.

In still another embodiment of this invention, the rounded end faces have a maximum roughness value of between 0.2μ and 0.4μ.

In yet an additional embodiment of this invention, the rounded end faces have a radius which is essentially equal to one half the thickness of the plates.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
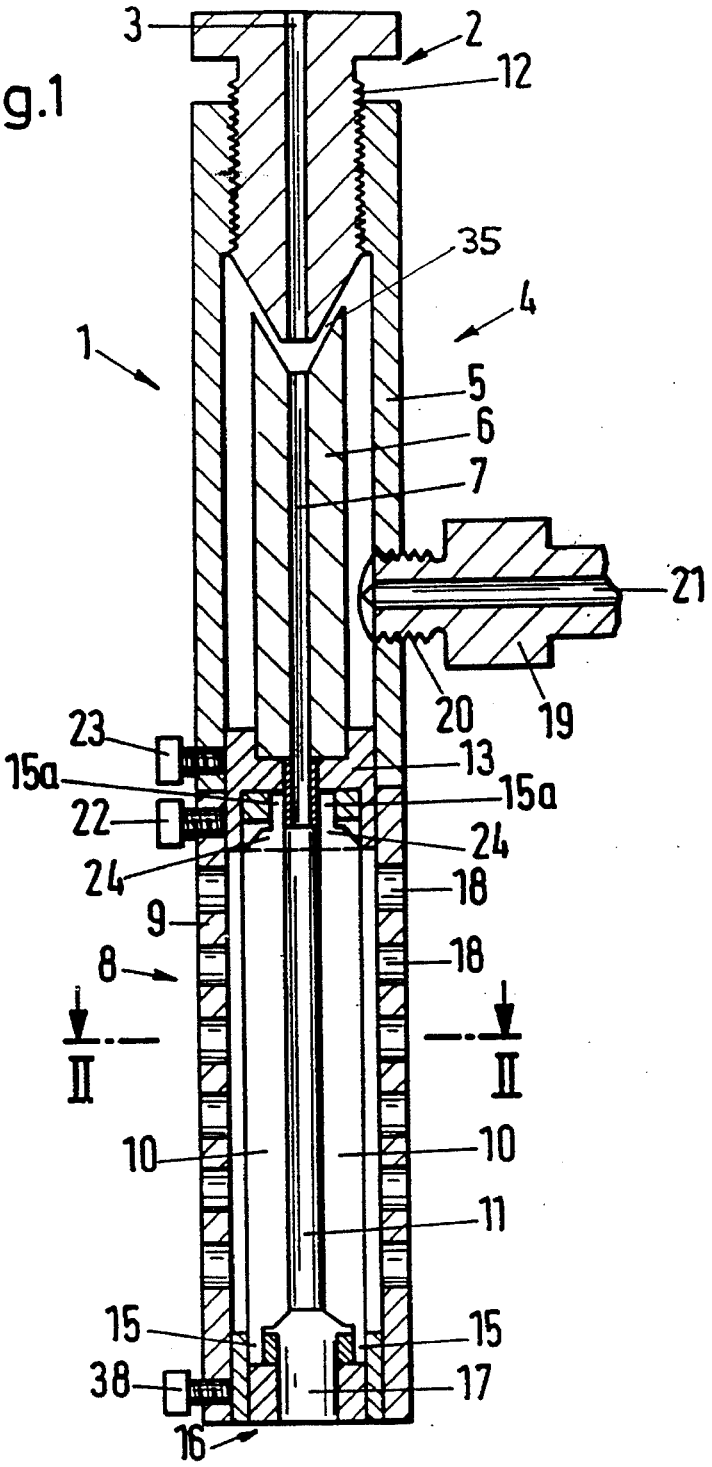
FIG. 1 shows the device of this invention as a semi-schematic longitudinal section taken along line I—I of FIG. 2.

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

The device 1 for texturizing continuous filament threads (not shown) of this invention includes a thread infeed part 2 having a thread infeed channel 3, a treatment part 4 having an exterior pipe 5, and an interior pipe 6 located therein which contains a treatment chamber 7.

Furthermore, device 1 includes, downstream of treatment part 4, a crimping part 8 with a perforated jacket pipe 9 having steel plates 10 located therein, which plates delimit a stuffer box 11.

Thread infeed part 2 is connected to exterior pipe 5 via a thread 12, and exterior pipe 5 and perforated jacket pipe 9 are centered, via an inner connection element 13, and are mutually connectable therewith via screws 22, 23 respectively. Connection element 13 furthermore serves on the one hand for the tight reception of interior pipe 6 (shown in FIG. 5 with dash-dot lines) and on the other hand for the pluggable reception of the upper (seen in the viewing direction of FIG. 1) plate ends 24 (FIGS. 1 and 3).

For this purpose, connection element 13 is provided with a ring-shaped insert 26, having slots 25 (FIGS. 5 and 6), which is tightly received in a cylindrical cavity 27 of connection element 13. Insert 26 has a bore with a diameter D and a depth or height R.

For the reception of the upper plate ends 24 of plates 10, slots 25 have a depth which is composed of the depth or height portions T and R. Furthermore, for the radial centering of plate ends 24, in connection element 13, a coaxial connection pipe 14 is provided which covers slots 25 for a length m.

Figure 3:
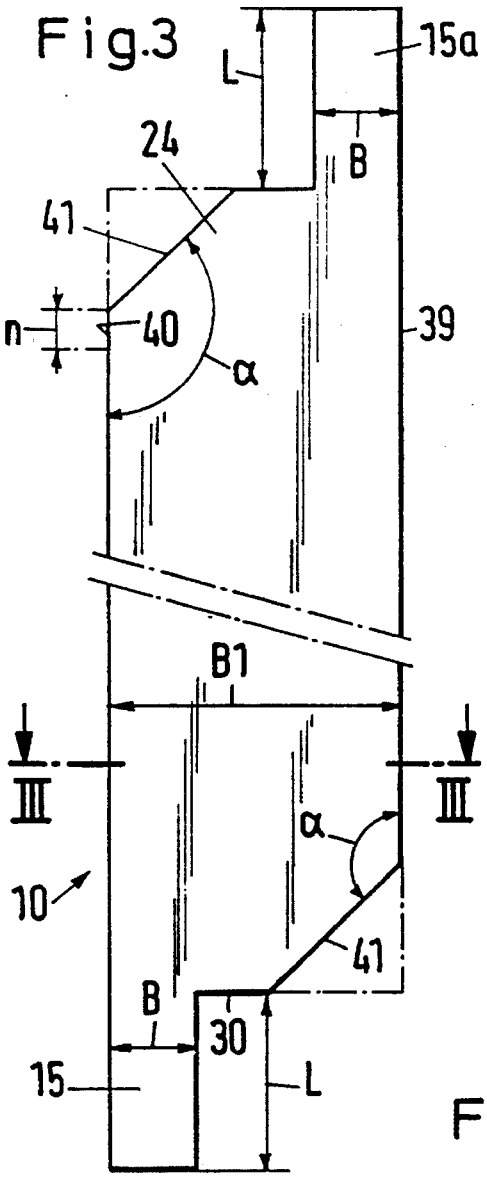
FIG. 3 is a greatly enlarged view of a part of the device of FIG. 1.
Figure 5:
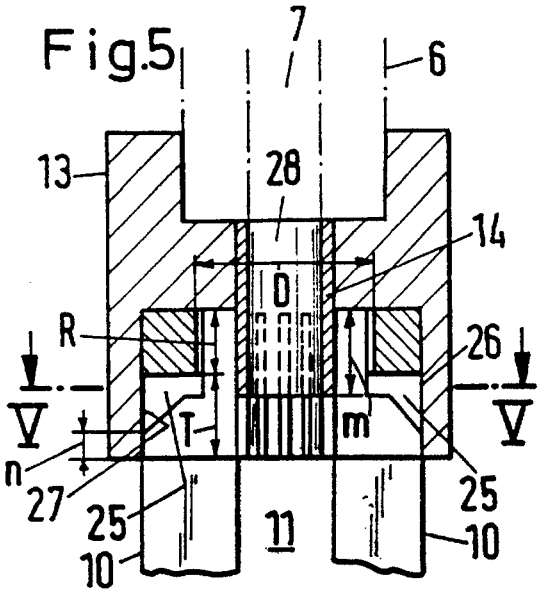
FIG. 5 is an enlarged longitudinal section taken through a detail of the device of FIG. 1, taken along line IV—IV of FIG. 6.
Figure 6:
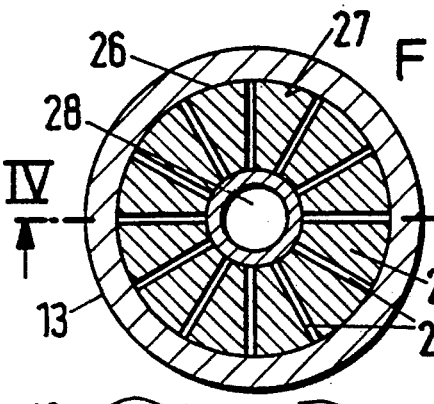
FIG. 6 is a cross section through the detail of FIG. 5, taken along line V—V of FIG. 5.
Figure 7:
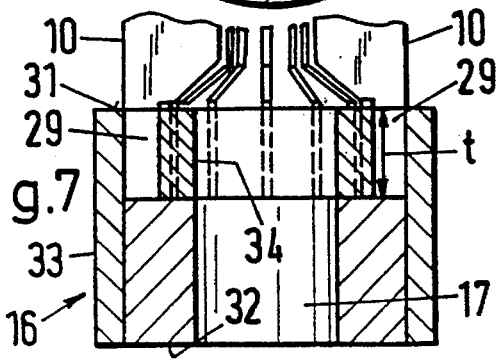
FIG. 7 is an enlarged longitudinal section through a further detail of the device of FIG. 1, taken along line VI—VI of FIG. 8.
Figure 4:
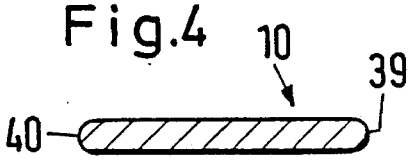
FIG. 4 is a cross section of the part of FIG. 3, taken along line III—III of FIG. 3.
Figure 8:
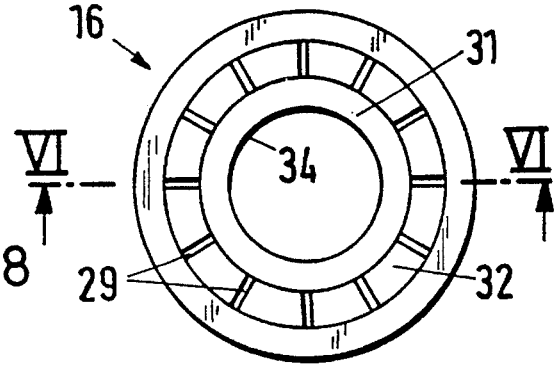
FIG. 8 is a top plan view of the detail of FIG. 7.

Therefore, upper plate ends 24 with prolongations or integral extensions **15*a* are, as indicated with dash-dot lines in FIG. 3 and shown in FIG. 5, radially supported at the inner rounded end face 39 along the length m and at the outer end face 40, which is also rounded, along the length n, in relation to the axis of device 1. The radius of each rounded end face 39, 40 essentially equals one half of the thickness of plates 10. Diameter D is chosen such that the surface limiting this diameter does not touch the plate prolongations 15*a***.

Furthermore, the tolerances at the guiding surfaces having the measures or extents m and n are chosen or selected in such a manner that upper plate end 24 is guided in a gliding or sliding manner in slot 25 with little play, e.g., 0.05 mm, such that plates 10 may expand in case they heat up more quickly than their surroundings without losing their flat shapes.

Connection pipe 14, in addition, has a connection bore 28 which connects treatment chamber 7 with stuffer area 11.

The lower ends of plates 10, formed again as prolongations or integral extensions 15, are tightly held or received in slots 29 of muzzle part 16. Here the length L of prolongations 15 is somewhat longer than the depth t of slots 29, so that an end surface 30 of plates 10 does not rest on the inner end face 31 of muzzle part 16.

Figure 2:
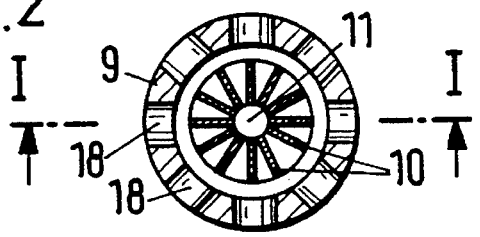
FIG. 2 is a semi-schematic section of the device of FIG. 1 taken along line II—II of FIG. 1.

In each slot 25, 29 respectively, a plate 10 is placed so that they are radially arranged, as shown in FIG. 2. For the formation of slots 29 muzzle part 16 consists of a ring body 32 that is provided with the slots 29, a sleeve 33 that embraces ring body 32 as well as an inner ring 34.

Muzzle part 16 also has a muzzle bore 17 from which the crimped thread (not shown) as well as a part of the treatment medium exit.

The other part or portion of the treatment medium, which escapes between plates 10, escapes through bores 18 of perforated jacket pipe 9.

A connection sleeve 19, connected to exterior pipe 5 via a thread 20, serves for the supply of the treatment medium into device 1.

More specifically, the treatment medium is transported via a supply channel 21 of connection sleeve 19 into a ring-shaped space 35 disposed between exterior pipe 5 and interior pipe 6, and enters into treatment chamber 7 from there. A screw 38, fitted into perforated jacket pipe 9, serves for the attachment of muzzle part 16.

Furthermore, as shown in FIGS. 1 and 3, prolongations 15 and **15*a* are centrically-symmetrically arranged (as e.g. like a propeller), this permitting, upon the excessive wear of the first end face, e.g. 39, of plates 10, to use the second end face, e.g., 40, by turning the plates, whereby the application duration or use of the plates is doubled as compared to that of the plates used in the current state of the art. Prolongations or extensions 15 and 15*a* have a width B that is smaller than the width B1 of plates 10, with prolongations 15 bordering directly on outer end face 40 of plates 10 and prolongations 15*a* bordering directly on plate inner end faces 39**.

In addition, chamfers 41, with an included angle $\alpha$ of an angle range of 120° to 150°, can be provided, which have the advantage over a 90° corner (shown in dash-dot lines in FIG. 3) in that any possible fibril loops, which have reached the area below the area denominated by length R, due to the expansion of the texturizing medium following connection pipe 14, will not snag and hence do not rupture.

The illustrated centrically-symmetric types of plates according to the invention, having the advantage of the noted reversing possibility, can also be employed without rounded end faces 39 and 40. Advantageously, however, this rounding is combined therewith.

Finally, it should also be noted that rounded end faces 39, 40 are polished and have a maximum roughness value Ra of 0.4μ, and preferably of 0.2μ, with 0.2μ being finer than 0.4μ.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A device for texturizing continuous filament threads by means of heated flowing media, the device including a thread infeed part for taking in the threads, a treatment part connected with the infeed part and having a treatment chamber for heating the threads, and a crimping part, the crimping part containing a slot nozzle, with the crimping part being connected to the treatment part, with the heated threads being stuffed into the crimping part for forming a crimping in the threads, the slot nozzle being provided with plates being inserted in slots, the plates having an essentially rectangular cross section having first and second end faces and being radially arranged with one of said end faces facing the stuffed thread, with every plate taking the form of a flat steel part, with the ends of each plate being provided with a prolongation, with these prolongations having a width smaller than the width of the plate, wherein one prolongation borders directly on one of said end faces of the plate and the other prolongation borders directly on another one of said end faces of the plate.

2. The device of claim 1, wherein the prolongations at the ends of each plate are centrically symmetrically offset relative to each other and have the same length and the same width.

3. The device of claim 1, wherein each plate end includes, in addition to the prolongation, a chamfer between the prolongation and a bordering one of said end faces of the plate and opposite to the prolongation, with the chamfer, together with the bordering one of said end faces, defining an angle within a given angle range.

4. The device of claim 3, wherein the angle range lies within 120° and 150°.

5. The device of claim 1, wherein the end faces of the plates are rounded and polished and have a maximum roughness value of 0.4μ.

6. The device of claim 1, wherein the end faces of the plates are rounded and polished and have a maximum roughness value of 0.2μ.

7. The device of claim 1, wherein the end faces of the plates are rounded and polished and have a radius which is essentially equal to one half the thickness of the plates.

8. A device for texturizing continuous filament threads by means of heated flowing media, the device including a thread infeed part for taking in the threads, a treatment part connected with the infeed part and having a treatment chamber for heating the threads, and a crimping part, the crimping part containing a slot nozzle, with the crimping part being connected to the treatment part, with the heated threads being stuffed into the crimping part for forming a crimping in the threads, the slot nozzle being provided with plates being inserted in slots, the plates having an essentially rectangular cross section having first and second end faces and being radially arranged with one of said end faces facing the stuffed thread, with every plate taking the form of a flat steel part, wherein the ends of each plate are provided with substantially similar centrally symmetrically offset extensions having a width smaller than the width of the plate.

9. The device of claim 8, wherein each plate end further includes a chamfer between the extension and a bordering one of said end faces of the plate and opposite to the extension, with the chamfer, together with the bordering one of said end faces, defines an angle in the range of between 120° and 150°.

10. The device of claim 9, wherein the end faces of the plates are rounded and polished, and have a radius which is essentially equal to one half the thickness of the plate.

11. The device of claim 10, wherein each rounded end face has a maximum roughness value of 0.2μ to 0.4μ.

* * * * *